US007988083B2

(12) United States Patent
Mazoyer

(10) Patent No.: US 7,988,083 B2
(45) Date of Patent: Aug. 2, 2011

(54) THREAD ACCUMULATION DEVICE

(75) Inventor: Michel Mazoyer, Pfastatt (FR)

(73) Assignee: Superba (SAS), Mulhouse (FR)

( * ) Notice: Subject to any disclaimer, the term of this patent is extended or adjusted under 35 U.S.C. 154(b) by 269 days.

(21) Appl. No.: 11/951,397

(22) Filed: Dec. 6, 2007

(65) Prior Publication Data

US 2008/0164360 A1 Jul. 10, 2008

Related U.S. Application Data

(60) Provisional application No. 60/881,174, filed on Jan. 19, 2007.

(30) Foreign Application Priority Data

Jan. 4, 2007 (FR) ..... 07 52525

(51) Int. Cl.
*B65H 51/20* (2006.01)

(52) U.S. Cl. ..... 242/364.8; 242/418

(58) Field of Classification Search ..... 242/364.6, 242/417–417.3, 366.3, 364.8, 364.7, 418.1; 226/44, 118.1–118.3
See application file for complete search history.

(56) References Cited

U.S. PATENT DOCUMENTS 3,175,444 A * 3/1965 Spinney ..... 83/251
4,984,341 A * 1/1991 Hagewood et al. ..... 28/185

FOREIGN PATENT DOCUMENTS

FR 2576885 A1 8/1986
GB 2274119 A 7/1994

OTHER PUBLICATIONS

French Search Report dated Jul. 9, 2007.

* cited by examiner

*Primary Examiner* — William E Dondero
(74) *Attorney, Agent, or Firm* — Young & Thompson

(57) ABSTRACT

A thread accumulation device that essentially consists of a discharge chute for receiving and guiding a strand that is formed by a thread take-up device (10) and a carriage (14) for taking up a thread spiral, guided in parallel to the longitudinal axis of the discharge chute that is equipped with a tension rail device and resting on the end of the strand of the side that is opposite to the thread take-up device (10). The device is characterized in that the carriage (14) for taking up a thread spiral that is guided on the discharge chute is equipped with a unit (16) for monitoring its movement and support on the end of the strand of the side that is opposite to the thread take-up device (10). The invention can be applied more particularly in the field of the textile industry, in particular of the treatment of thread.

16 Claims, 5 Drawing Sheets

THREAD ACCUMULATION DEVICE

FIELD OF THE INVENTION

This relates to the field of the textile industry, in particular of the treatment of thread, in particular by means of heat treatment machines that are now called heat-setting machines, as well as other lines of treatment or production, in which the thread is transported between different treatment stations, in which the speeds of advance can be different, and it has as its object a thread accumulation device.

BACKGROUND OF THE INVENTION

The machines for treating threads, used in the field of the textile industry, are often placed in a line to make possible different treatments of the textile threads continuously and thus a resultant high yield from a minimum number of interruptions of the process for production or treatment, for example for the sake of modifying the speed of advance of the threads in a machine relative to the preceding and/or following machines, and even for the sake of a necessary total stop of a machine, for example a winder for the replacement of full spools.

It is therefore advisable to ensure an intermediate storage of the threads to compensate for the speed differential that may exist between two thread treatment stations, so as to allow collision-free operation of a line for production and/or treatment.

For this purpose, a textile thread-accumulating device that uses a device for taking up threads in coils on the end of a longitudinal support and means for taking up said threads at the other end of this support is known by FR-A-2 576 885.

Such a device makes it possible to carry out a correct accumulation of threads but it is not suitable for modern treatment and/or production lines whose very high operating speeds call for a significant accumulation capacity to take into account programmed cyclic interruptions or to make possible a smooth stopping of the line, i.e., with no significant impact requiring a very long reactivation time in the case of an accidental failure of a work station.

To prevent this drawback, it has been proposed to produce an accumulator device that consists essentially of a discharge chute that is placed as an extension from the outlet of a device for taking up the thread from a stranded-thread spiral, whose end that is opposite to the thread take-up device is guided in such a way as to be taken up and unwound by a downstream treatment or production station, whereby said discharge chute has a lateral upward slope starting from the thread take-up device toward its opposite end.

So as to regulate the speed and the tension of the strand during the unwinding, the discharge chute is equipped with a carriage that is guided over said discharge chute and that rests on the end of the strand of the side that is opposite to the thread take-up device, whereby this carriage is provided with strand guide means in the form of a guiding eyelet and/or a guiding and return bar. In addition, this carriage can be weighted in order to produce a support force on the head of the strand, at the outlet of the thread spiral, essentially to brake and monitor the strand during unwinding, i.e., to allow a certain tension of the thread spiral, as well as to obtain a predetermined strand density.

The devices of this type make possible, from the very fact of their constitution, an easy adaptation to the work conditions, i.e., that if a significant accumulation is to be made, the only thing that needs to be done is to extend the discharge chute accordingly.

However, the accumulation devices of this type have the drawback of always having to be more or less inclined relative to the horizontal line to allow an effective action of the weighted carriage on the thread strand in formation and to ensure a correct tension of the thread spiral at the outlet of said carriage. In addition, taking into account this slope of the discharge chute, the vertical space that is occupied by these devices can become significant as the discharge chute is extended, and it then becomes necessary to provide for the operator elevated access means that extend over several levels, such as walkways, etc. High installation costs are the result.

In addition, the thread strand moves into the discharge chute by sliding into the latter and, starting from a certain length and based on the thread, the thus produced friction action on the wall of the discharge chute becomes significant, which, in combination with the action of the carriage, leads to an increase in the density of the strand.

This results in an impossibility of forming a homogeneous accumulation and a difficulty in taking up the thread spiral, such that the good operation of the treatment line can be affected. However, with the enhancement of the performance levels of the current treatment lines, the speed of taking up the threads increases proportionally and the adjustment of the take-up tension is difficult to carry out and takes too long because, to make this adjustment, the operator has to walk along the discharge-chute service walkway and install a ballast weight on the carriage. Consequently, the reaction time between the verification of a poor separation and the moment of the intervention that tends to modify the parameters of loads by means of the carriage is too long, and the action carried out runs the risk of being unsuitable.

In addition, the current increase of the speeds brings about a critical disadvantage for the safety of the operator. Actually, because of the tension of the wires, a break in the separation zone of the latter may have the consequence of the formation of a lasso-shaped loop that can hook onto the carriage, which can then be abruptly entrained at the same speed as the wires and can be ejected from the discharge chute without the automatic safety devices being able to react.

SUMMARY OF THE INVENTION

This invention has as its object to eliminate these drawbacks by proposing a thread accumulation device whose vertical space that is occupied is reduced and which makes it possible to ensure a homogeneous accumulation of a stranded-thread spiral and an easy taking-up of said thread spiral.

For this purpose, the thread accumulation device, which essentially consists of a discharge chute for receiving and guiding a strand that is formed by a thread take-up device and a carriage for taking up a thread spiral, guided in parallel to the longitudinal axis of said discharge chute and resting on the end of the strand of the side that is opposite to the thread take-up device, is characterized in that the carriage for taking up a thread spiral that is guided on the discharge chute is equipped with a means of monitoring its movement and the support on the end of the strand of the side that is opposite to the thread take-up device.

BRIEF DESCRIPTION OF THE DRAWINGS

The invention will be better understood owing to the description below that relates to preferred embodiments, given by way of nonlimiting examples and explained with reference to the accompanying diagrammatic drawings, in which.

DETAILED DESCRIPTION OF EMBODIMENTS

Figure 1:
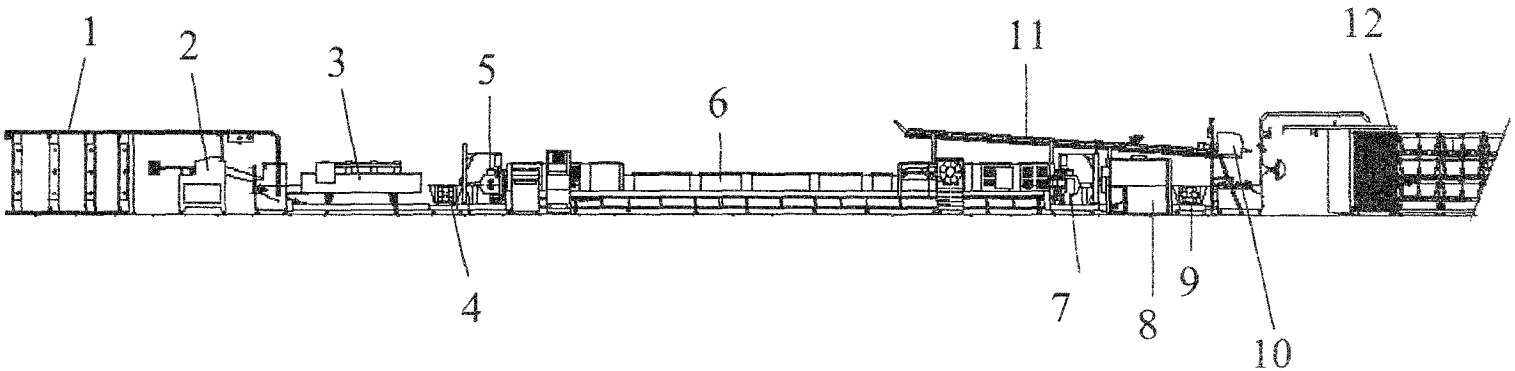
FIG. 1 is a lateral elevation view of a thread treatment line that comprises the thread accumulation device according to the invention.
Figure 2:
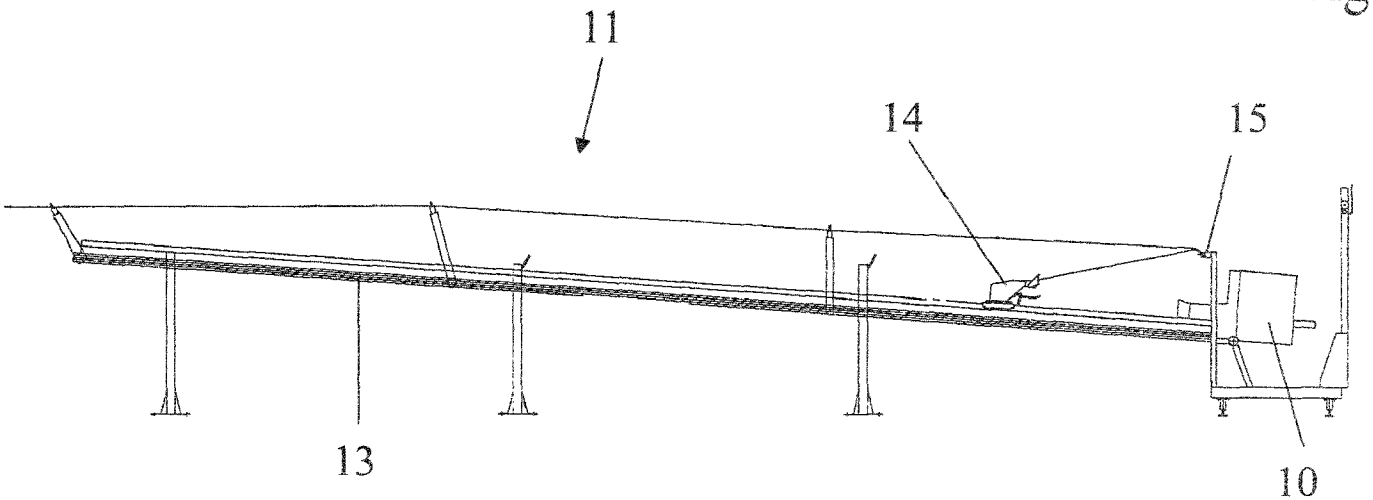
FIG. 2 is a lateral elevation view on an enlarged scale, showing the device according to the invention by extending a thread take-up device.
Figure 3:
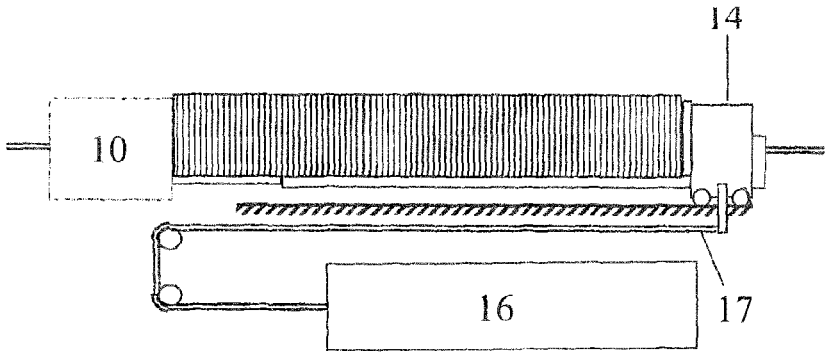
FIG. 3 is an enlarged partial view of FIG. 2, whereby the device is in horizontal position.

FIG. 1 of the accompanying drawings shows, by way of example, a heat-setting line that consists of a creel 1, of a head or machine for curling 2 that makes it possible to deposit the threads on a conveyor belt, of a steaming unit 3, and of a cooling unit 4 that is extended by a sealing head 5 of a heat-setting tunnel 6 that is equipped at its other end with an outlet sealing head 7 that empties into a drier 8, which is extended by a cooling device 9.

At the outlet of this device, the threads are taken up continuously by a thread take-up device 10 to be routed to a winder 12. Because the winder 12 operates intermittently to allow the doffing of the full spools and the installation of new empty spools, the treatment line is equipped—between the thread take-up device 10 and the winder 12—with a thread accumulation device 11.

Such a device 11, which essentially consists of a discharge chute 13 for receiving and guiding a strand that is formed by the thread take-up device 10 and a carriage 14 for taking up a thread spiral, guided on said discharge chute 13 that is equipped with a tension rail device 15 and that rests on the end of the strand of the side that is opposite to the thread take-up device 10, makes it possible to improve the efficiency of the treatment line and to ensure that the delicate threads that should not remain in the heat-setting tunnel 6 except for a limited time are preserved. It thus is possible, with each stop of the winder during the doffing cycles, or following a breaking of thread or the activation of a tuft guard, therefore after the take-up of threads, that the heat-setting line continues to operate normally, i.e., without interruption, whereby the accumulation device 11 carries out a temporary storage of the thread that is produced, i.e., that acts as a buffer.

According to the invention, the carriage 14 for taking up a thread spiral, guided in parallel to the longitudinal axis of the discharge chute 13, is equipped with a means 16 of monitoring its movement and the support on the end of the strand of the side that is opposite to the thread take-up device 10.

Such a means 16 of monitoring the movement and the support of the carriage 14 for taking up the thread spiral on the end of the strand of the side that is opposite to the thread take-up device 10 can consist of a traction means that acts on the carriage 14 for taking up the thread spiral on its side that is turned toward the thread take-up device 10 (FIGS. 3 to 6).

Figure 4:
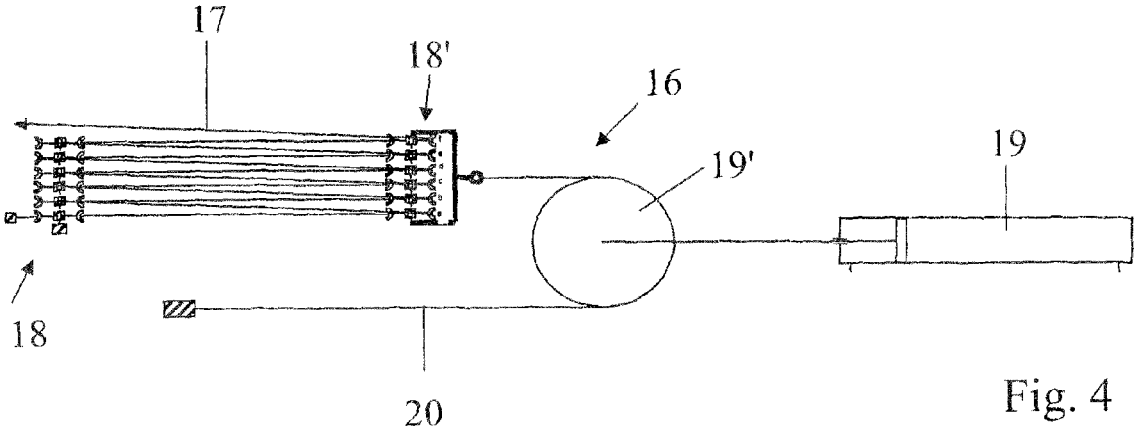
FIG. 4 is a diagrammatic lateral elevation view of a means of monitoring the movement of the carriage.

FIG. 4 of the accompanying drawings shows a preferred embodiment of such a traction means that consists of a reaction cable 17 that is mounted on a pair of pulley blocks 18, 18', of which the mobile pulley block 18' is connected to a device 19 for actuation in translation. Thus, the end of the carriage 14 that is turned toward the thread take-up device 10 is connected to one end of the traction cable 17 that is mounted on the pair of pulley blocks 18, 18', and the mobile pulley block 18' works with the device 19 for actuation in translation, such that any movement of the thread take-up carriage 14 will have the result of exerting traction on the mobile pulley block 18' that is connected to the actuating device 19.

This actuating device 19 is designed to monitor the movement of the carriage 14 and therefore to brake said carriage 14 during this movement, so as to ensure an advance speed of the carriage 14 that is suitable for the formation speed of the thread strand. For this purpose, the actuating device 19 consists of a traction cylinder that acts on the mobile pulley block 18' via a return pulley 19' that is mounted on its piston rod and works with a cable 20 that is connected by one end to said mobile pulley block 18' and by its other end to a stationary point that is provided on the infrastructure of the discharge chute 13.

Thus, as a thread strand is unwound on the discharge chute 13, the carriage 14 is subjected to a load under the action of the pressure that is exerted by said thread strand and is pushed in a direction that is opposite to the thread take-up device 10. Traction on the cable 17, mounted on the pulley blocks 18, 18', follows, which has the effect of transmitting corresponding traction to the cable 20, guided on the return pulley 19' of the cylinder that constitutes the actuating device 19. However, since the cable 20 is connected by its other end to a stationary point of the infrastructure of the discharge chute 13, there is no possibility of lengthening the latter and the movement of the mobile pulley block 18' is possible only in correspondence with a movement of the cylinder that forms the actuating means 19.

For this purpose, the cylinder is advantageously controlled by means of an automatic device, not shown and known in the art, whereby this automatic device delivers, based on data corresponding to a maximum pressure that is allowed on the end of the strand that is guided in the discharge chute 13, a signal for compensation for the corresponding pressure in the cylinder, allowing a proportional movement of its piston rod and therefore of the return pulley 19'. Such an automatic device operates in relation to pressure sensors of movement and of end-of-travel, also known, and does not require a special description, not being an essential element of this invention. The movement of the return pulley 19' has as a consequence a movement of the mobile pulley block 18' that releases a corresponding cable length 17.

The available cable length for the movement of the carriage 14 on the discharge chute 13 can easily be regulated by maintaining an acceptable course of the cylinder that forms the actuating device 19 by provision of a sufficient number of return pullies on the pulley blocks 18, 18'. Actually, the available length of cable 20 for a given length requirement of a pair of pulley blocks and a predetermined movement of the carriage 14 is based on the number of cable strands that are mounted on the pullies of said pulley blocks. In addition, a large number of pulleys allows the use of a cylinder of a relatively low power and a length requirement that is also limited.

It is also possible, according to a variant embodiment of the invention, not shown in the accompanying drawings, to replace the cylinder that forms the actuating device 19 by a ballast weight acting on the return pulley 19', via a geared motor, via a linear cylinder or via a magnetic coupling.

Figure 5:
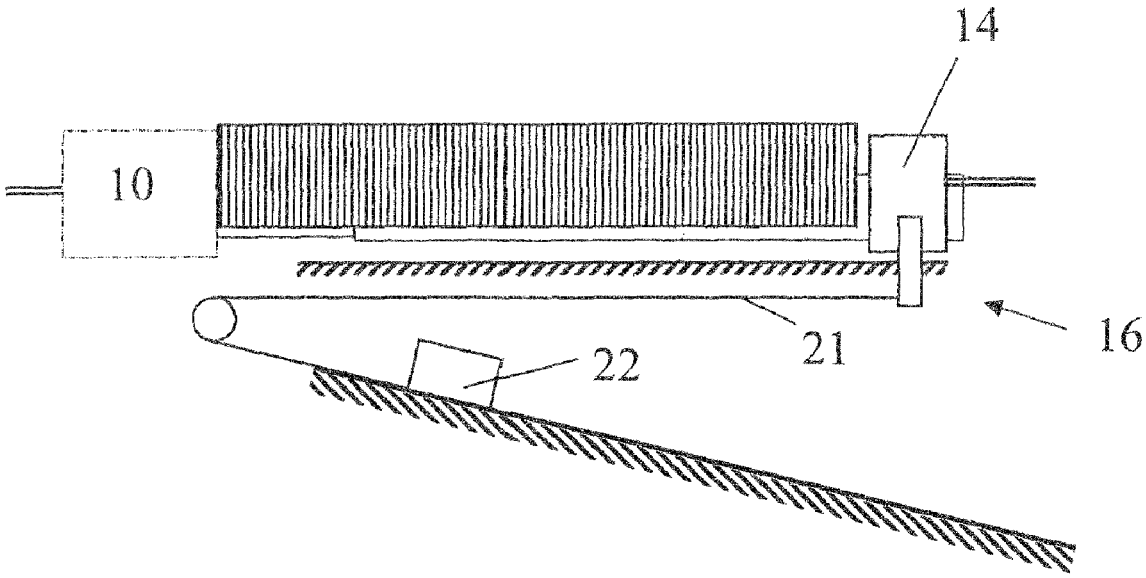
FIG. 5 is a view that is analogous to that of FIG. 4 of a variant embodiment of the means of monitoring the movement of the carriage.

According to another embodiment of the invention and as FIG. 5 of the accompanying drawings shows it, the means 16 of monitoring the movement and support of the carriage 14 for taking up a thread spiral on the end of the strand of the side that is opposite to the thread take-up device 10 can simply consist of a cable 21 that acts on the carriage 14 for thread spiral take-up on its side that is turned toward the thread take-up device 10, whereby this cable 21 is connected to a ballast weight 22. Such an embodiment allows a particularly simple execution of the means 16 of monitoring the movement and support of the carriage 14, whereby the support force of the latter against the strand that is formed by winding of the thread spiral is simply predetermined by the calculation of the weight of the ballast weight 22.

To take into account the friction that is produced during a significant accumulation of threads in the discharge chute 13, i.e., when the spiral reaches a significant length, provision can be made to influence the force that is developed by the ballast weight, for example by guiding the latter over an incline whose slope can be varied continuously by means of a guided cylinder (not shown).

Figure 6:
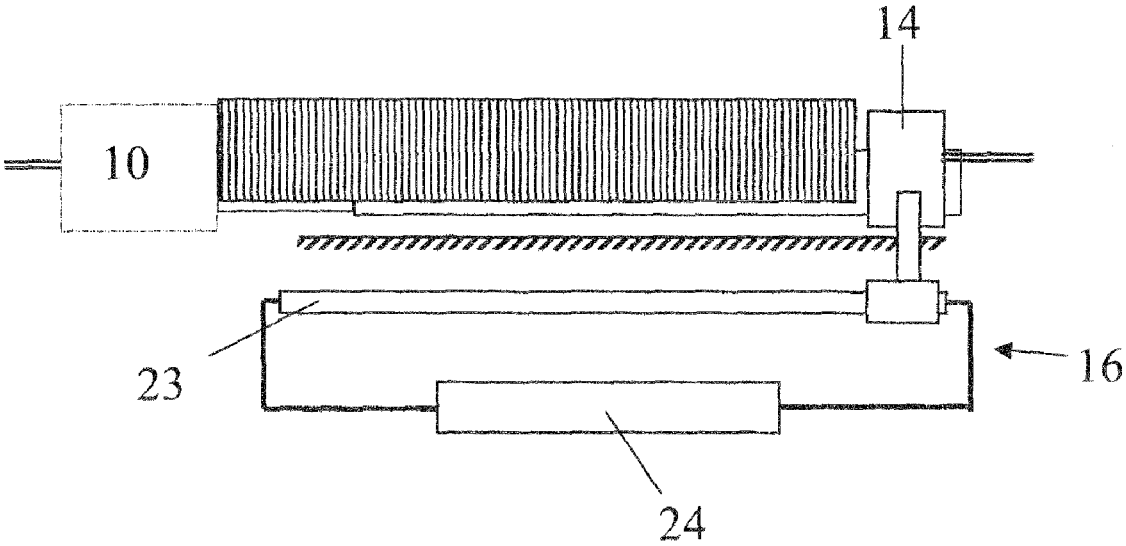
FIG. 6 is a view that is analogous to that of FIG. 4 of another variant embodiment of the means of monitoring the movement of the carriage.

According to another variant embodiment of the invention, shown in FIG. 6 of the accompanying drawings, the means 16 of monitoring the movement and support of the carriage 14 for taking up a thread strand on the end of the strand of the side that is opposite to the thread take-up device 10 can also consist of a linear cylinder with magnetic coupling 23 that is connected to the carriage 14 and guided by means of a pneumatic guiding device 24 that is connected to an automatic command and control device, not shown, taking into consideration the support force that is exerted on the end of the strand by the carriage 14.

Figure 7:
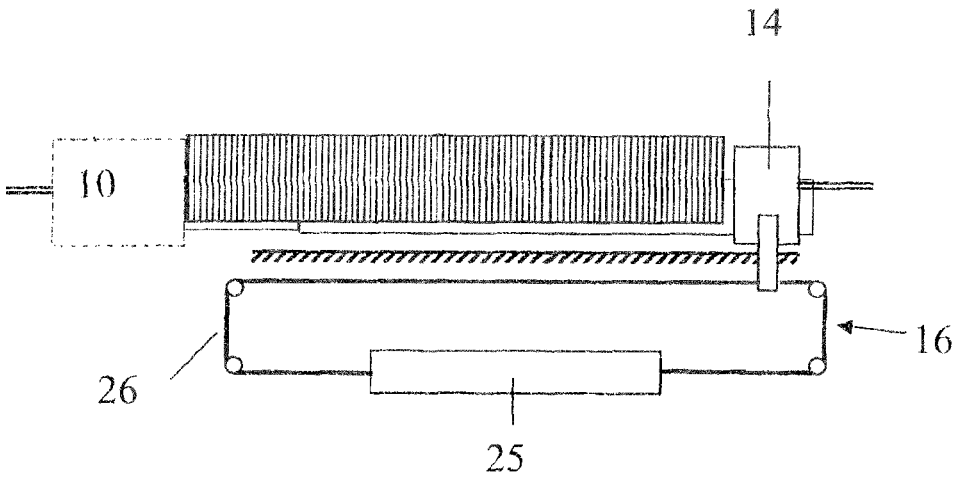
FIG. 7 is a view that is analogous to those of FIGS. 5 and 6 of a third variant embodiment of the means of monitoring the movement of the carriage.

FIG. 7 of the accompanying drawings shows a third variant embodiment of the invention, in which the means 16 of monitoring the movement and support of the carriage 14 for taking up a thread spiral on the end of the strand, of the side that is opposite to the thread take-up device 10, consists of a geared-motor drive device 25 that acts on a chain, a cable, a toothed drive belt, etc. 26, whose ends are connected to the carriage 14. Thus, it is possible to monitor perfectly the movement of the carriage 14 by guiding the geared motor 25 based on the accumulation of the strand in front of the carriage 14 and the pressure that is exerted on the latter.

In this case, the geared-motor drive device 25 can be used both as a device for braking the carriage 14 at the beginning of the formation of the strand and as a device for driving the carriage 14 in the presence of a strand of great length or during the decreasing of the length of the strand.

Figure 8:
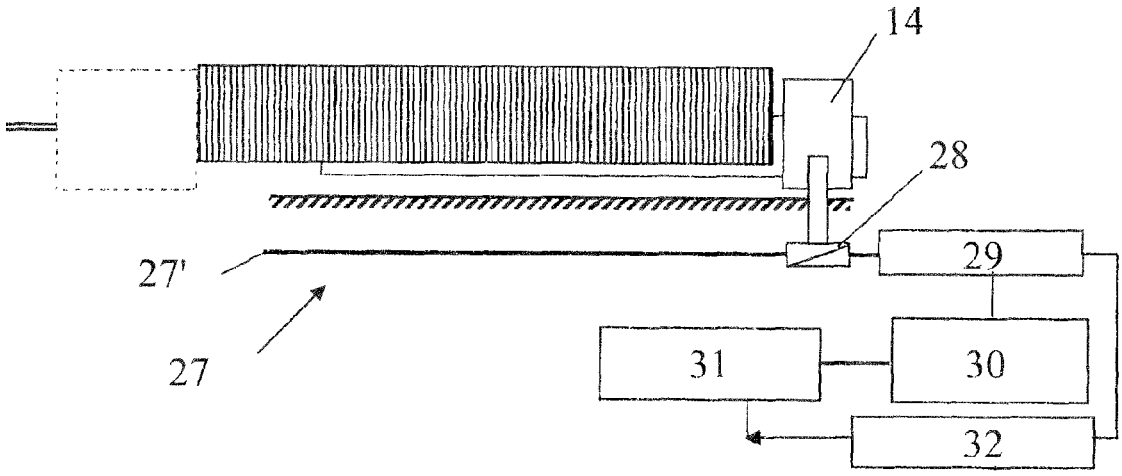
FIG. 8 is a view that is analogous to those of FIGS. 5 to 7 that show a fourth variant embodiment of the means of monitoring the movement of the carriage.

In the embodiment shown in FIG. 8 of the accompanying drawings, the means 16 of monitoring the movement and support of the carriage 14 for taking up a thread spiral on the end of the strand, of the side that is opposite to the thread take-up device 10, consists of a screw cylinder 27, whose nut 28 is made integral with the carriage 14 and whose screw 27' is driven by a motor 29 that is controlled by means of an a.c. servo drive 30. This a.c. servo drive 30 can be connected to a guide device 31, taking into account the data from a torque-monitoring means 32 connected to the servo-motor 29 and the data obtained from an automatic command and control device, not shown. Thus, it is possible, based on the maximum pressure allowed on the head of the carriage 14 that is turned toward the strand, to actuate the screw 27' in the direction of an increase or a decrease of the pressure that is exerted on the strand to move the carriage 14 in a corresponding manner.

According to a variant embodiment of the means 16 according to FIG. 8, not shown in the accompanying drawings, said means 16 of monitoring the movement and support of the carriage 14 for taking up a thread spiral on the end of the strand, of the side that is opposite to the thread take-up device 10, can consist of a screw cylinder, whose nut is driven by a motor that is made integral with the carriage and that is controlled by means of an a.c. servo drive and whose screw is made integral with the frame of the discharge chute 13.

It is also possible, according to another variant embodiment of the invention, not shown in the accompanying drawings, to replace the screw cylinder 27 by a wheel and rack assembly, whose rack is mounted on the frame of the discharge chute 13 and whose wheel, which engages with the rack, is driven by a motor or a geared-motor assembly that is mounted on the carriage 14. In such a case, the motor or the geared-motor assembly can invariably be used as a device for braking the carriage 14 at the beginning of the formation of the strand and as a device for driving the carriage 14 in the presence of a strand of great length or during the decrease of the length of the strand.

Figure 9:
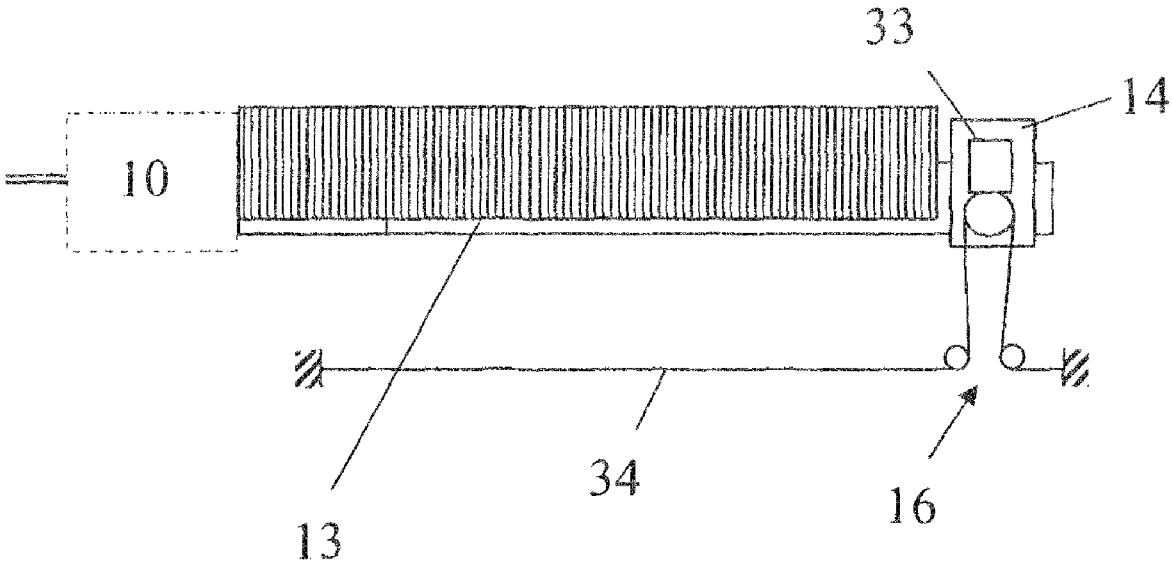
FIG. 9 is a view that is analogous to those of FIGS. 5 to 8 that show a fifth variant embodiment of the means of monitoring the movement of the carriage.

FIG. 9 of the accompanying drawings shows a fourth variant embodiment of the invention, in which the means 16 of monitoring the movement and support of the carriage 14 for taking up a thread spiral on the end of the strand, of the side that is opposite to the thread take-up device 10, consists of a geared-motor assembly 33 that is mounted on the carriage 14 and that works with a cable 34, a chain or a belt that is attached at its two ends to the support frame of the discharge chute 13. Thus, the carriage 14 can be moved over the discharge chute 13, in one direction or the other, by simple traction on the cable 34, the chain or the belt, by means of the geared-motor assembly 33.

Thanks to the invention, it is possible to improve very clearly the accumulation of thread in a treatment or production line by making possible the production of a homogeneous strand and an easy taking-up of said thread spiral that forms said strand, this by means of a device whose vertical space that is occupied can be reduced.

Actually, because of the monitoring of the movement of the carriage 14 for taking up the thread spiral on the end of the strand, the discharge chute for guiding said strand can be placed on the horizontal line, such that the vertical space that it occupies is constant and can therefore be reduced to a minimum so as to allow the operator to act on the device starting from a uniform surface, regardless of the accumulation capacity of the device. The monitoring of the movement of the carriage 14 can even allow a negative slope of the discharge chute 13.

In addition, the work of the operator is facilitated by the fact that it is no longer necessary to act manually on the carriage 14 to adjust the separation tension of the threads, whereby the latter are monitored and adjusted continuously by means of the automatic device for monitoring the movement of the carriage 14.

Finally, the possible variations of the removal speed of the threads of the strand accumulated in front of the carriage 14, which have the result of corresponding variations of the length of said strand, are instantaneously compensated for by a corresponding movement of the carriage 14, such that its force of application on the end of the strand remains constant. It follows that the thread spiral that is accumulated in a strand acts perfectly well as a buffer and makes it possible to optimize the yield of a thus equipped treatment line.

Of course, the invention is not limited to the embodiments that are described and shown in the accompanying drawings. Modifications remain possible, in particular from the viewpoint of the constitution of the various elements or by substitution of equivalent techniques, without thereby exceeding the field of protection of the invention.

The invention claimed is:

1. A thread accumulation device, which essentially consists of:

a discharge chute for receiving and guiding a strand that is formed by a thread take-up device; and a carriage for taking up a thread spiral, said carriage is guided in parallel to a longitudinal axis of said discharge chute, said discharge chute is equipped with a tension rail device and said carriage bears on an end of the strand of a side that is opposite to the thread take-up device, wherein the carriage is equipped with a means of monitoring movement and support of the carriage on the end of the strand of the side that is opposite to the thread take-up device.

2. The device according to claim 1, wherein the means of monitoring the movement and support of the carriage for taking up the thread spiral on the end of the strand of the side that is opposite to the thread take-up device consists of a traction means acting on the carriage for taking up the thread spiral on its side that is turned toward the thread take-up device.

3. The device according to claim 2, wherein the means of monitoring the movement and support of the carriage for taking up the thread spiral on the end of the strand of the side that is opposite to the thread take-up device consists of a traction cable that is mounted on a pair of pulley blocks, a mobile one of said pulley blocks is connected to a device for actuation in translation.

4. The device according to claim 3, wherein the actuating device consists of a traction cylinder that acts on the mobile one of said pulley blocks by means of a return pulley that is mounted on a piston rod and that works with a cable that is connected by one end to said mobile one of said pulley blocks and by an other end to a stationary point that is provided on infrastructure of the discharge chute.

5. The device according to claim 4, wherein the cylinder that constitutes the actuating device is controlled by means of an automatic device that delivers, based on data corresponding to a maximum pressure allowed on the end of the strand that is guided into the discharge chute, a signal for compensating for the corresponding pressure in the cylinder, allowing a proportional movement of the piston rod and therefore of the return pulley.

6. Device, according to claim 5, wherein the cylinder that constitutes the actuating device (19) is replaced by a ballast weight that acts on the return pulley (19'), via a geared motor, via a linear cylinder or via a magnetic coupling.

7. Device, according to claim 4, wherein the cylinder that constitutes the actuating device (19) is replaced by a ballast weight that acts on the return pulley (19'), via a geared motor, via a linear cylinder or via a magnetic coupling.

8. Device, according to claim 1, wherein the means (16) of monitoring the movement and support of the carriage (14) for taking up a thread spiral on the end of the strand of the side that is opposite to the thread take-up device (10) consists of a cable (21) that acts on the carriage (14) for taking up the thread spiral on its side that is turned toward the thread take-up device (10), whereby this cable (21) is connected to a ballast weight (22).

9. Device, according to claim 8, wherein the ballast weight (22) is guided over an incline, whose slope can be varied continuously by means of a guided cylinder.

10. Device, according to claim 1, wherein the means (16) of monitoring the movement and support of the carriage (14) for taking up a thread spiral on the end of the stand of the side that is opposite to the thread take-up device (10) consists of a linear cylinder with magnetic coupling (23) that is connected to the carriage (14) and guided by means of a pneumatic guiding device (24) that is connected to an automatic device for command and control, taking into consideration the support force that is exerted on the end of the strand by the carriage (14).

11. Device, according to claim 1, wherein the means (16) of monitoring the movement and support of the carriage (14) for taking up a thread spiral on the end of the strand, of the side that is opposite to the thread take-up device (10), consists of a geared-motor drive device (25) that acts on a chain, a cable, or a toothed drive belt (26), whose ends are connected to the carriage (14).

12. Device, according to claim 1, wherein the means (16) of monitoring the movement and support of the carriage (14) for taking up a thread spiral on the end of the strand, from the side that is opposite to the thread take-up device (10), consists of a screw cylinder (27), whose nut (28) is made integral with the carriage (14) and whose screw (27') is driven by a motor (29) that is controlled by means of an a.c. servo drive.

13. Device, according to claim 12, wherein the a.c. servo drive (30) is connected to a guide device (31), taking into consideration the data from a torque-monitoring means (32) connected to the servo-motor (29) and the data obtained from an automatic command and control device.

14. Device, according to claim 12, wherein the screw cylinder (27) is replaced by a wheel and rack assembly, of which the rack is mounted on the frame of the discharge chute (13) and of which the wheel, which engages with the rack, is driven by a motor or a geared-motor assembly that is attached to the carriage (14).

15. Device, according to claim 1, wherein the means (16) of monitoring the movement and support of the carriage (14) for taking up a thread spiral on the end of the strand, of the side that is opposite to the thread take-up device (10), consists of a screw cylinder, whose nut is driven by a motor that is made integral with the carriage and is controlled by means of an a.c. servo drive and whose screw is made integral with the frame of the discharge chute (13).

16. Device, according to claim 1, wherein the means (16) of monitoring the movement and support of the carriage (14) for taking up a thread spiral on the end of the strand, of the side that is opposite to the thread take-up device (10), consists of a geared-motor assembly (33) that is mounted on the carriage (14) and that works with a cable (34), a chain, or a belt that is attached at its two ends to the support frame of the discharge chute (13).

* * * * *